US011204574B2

(12) United States Patent
Moalem et al.

(10) Patent No.: US 11,204,574 B2
(45) Date of Patent: Dec. 21, 2021

(54) IDENTIFICATION AND REMEDY OF BLANKET CREEP CONDITIONS

(71) Applicant: Hewlett-Packard Development Company, L.P., Spring, TX (US)

(72) Inventors: Sasi Moalem, Ness Ziona (IL); Kobi Shkuri, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/975,831

(22) PCT Filed: Apr. 23, 2018

(86) PCT No.: PCT/US2018/028839
§ 371 (c)(1),
(2) Date: Aug. 26, 2020

(87) PCT Pub. No.: WO2019/209244
PCT Pub. Date: Oct. 31, 2019

(65) Prior Publication Data
US 2021/0041821 A1 Feb. 11, 2021

(51) Int. Cl.
*G03G 15/00* (2006.01)

(52) U.S. Cl.
CPC ..... *G03G 15/5054* (2013.01)

(58) Field of Classification Search
CPC ..... G03G 15/5054; G03G 15/24; G03G 15/1605; G03G 15/55; G03G 15/161; G03G 2215/1676
See application file for complete search history.

(56) References Cited

U.S. PATENT DOCUMENTS

| | | | | |
|---|---|---|---|---|
| 5,784,957 | A | 7/1998 | Rau et al. | |
| 6,626,104 | B2 | 9/2003 | Albus et al. | |
| 7,644,658 | B2 | 1/2010 | Nagler et al. | |
| 8,749,603 | B2 | 6/2014 | Thayer et al. | |
| 9,229,664 | B2 | 1/2016 | Landa et al. | |
| 2011/0262168 | A1 | 10/2011 | Matsumoto | |
| 2014/0241740 | A1* | 8/2014 | Naruse | G03G 15/55 399/33 |
| 2015/0338760 | A1* | 11/2015 | Ohta | G03G 15/5054 399/301 |
| 2017/0160678 | A1* | 6/2017 | Portnoy | G03G 15/161 |
| 2017/0361602 | A1 | 12/2017 | Landa et al. | |

FOREIGN PATENT DOCUMENTS

| | | |
|---|---|---|
| GB | 2286822 | 8/1995 |
| JP | 2006224493 | 8/2006 |
| JP | 2010284829 | 12/2010 |

* cited by examiner

*Primary Examiner* — Sandra Brase
(74) *Attorney, Agent, or Firm* — Dicke Billig & Czaja PLLC

(57) ABSTRACT

In one example of the disclosure, a first sensor located adjacent to a first end of the blanket drum is utilized to take a first temperature reading. A second sensor located adjacent to a second end of the blanket drum is utilized to take a second temperature reading. A blanket creep condition is identified responsive to determining a difference in blanket drum temperatures is in excess of a predetermined threshold. A remedial measure is caused to be performed to address the blanket creep condition.

13 Claims, 6 Drawing Sheets

IDENTIFICATION AND REMEDY OF BLANKET CREEP CONDITIONS

BACKGROUND

A printer may apply print agents to a paper or another substrate. One example of a printer is a Liquid Electro-Photographic ("LEP") printer, which may be used to print using a fluid print agent such as an electrostatic printing fluid. Such electrostatic printing fluid includes electrostatically charged or chargeable particles (for example, resin or toner particles which may be colorant particles) dispersed or suspended in a carrier fluid).

DRAWINGS

DETAILED DESCRIPTION

Figure 1:
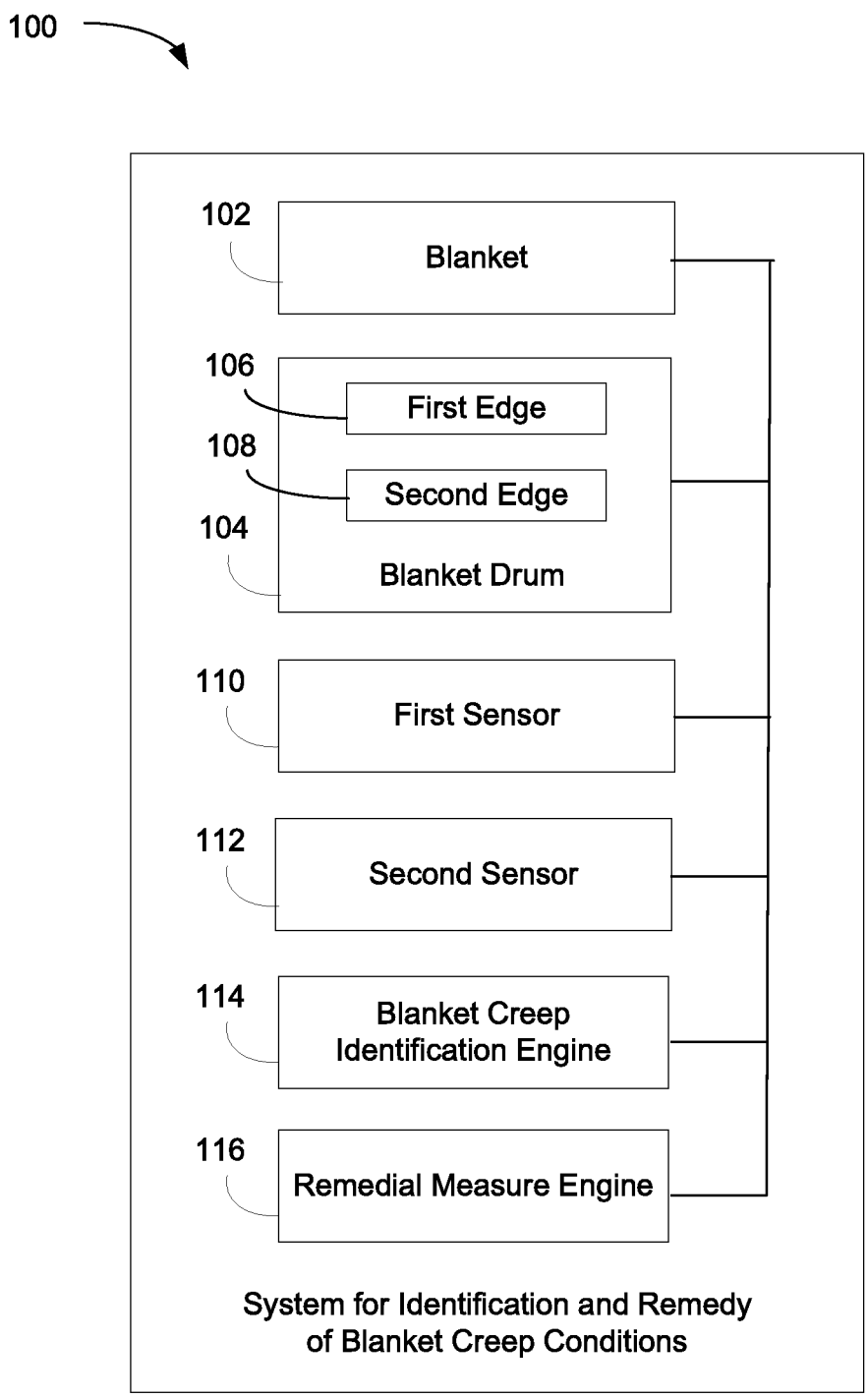
FIG. 1 illustrates an example of a system for identification and remedy of blanket creep conditions.

In an example of LEP printing, a printing device may form an image on a print substrate by placing an electrostatic charge on a photoconductor, and then utilizing a laser scanning unit to apply an electrostatic pattern of the desired image on the photoconductor to selectively discharge the photoconductor. The selective discharging forms a latent electrostatic image on the photoconductor. The printing device includes a development station to develop the latent image into a visible image by applying a thin layer of electrostatic ink (which may be generally referred to as "LEP ink", or "electronic ink" in some examples) to the patterned photoconductor. Charged toner particles in the LEP ink adhere to the electrostatic pattern on the photoconductor to form a liquid ink image. In examples, the liquid ink image, including colorant particles and carrier fluid, is transferred utilizing a combination of heat and pressure from the photoconductor to an intermediate transfer member (referred herein as a "blanket") attached to a rotatable blanket drum. The blanket is heated until carrier fluid evaporates and colorant particles melt, and a resulting molten film representative of the image is then applied to the surface of the print substrate via pressure and tackiness. In examples the blanket that is attached to the blanket drum is a consumable or replaceable blanket.

For printing with colored inks, the printing device may include a separate development station for each of the various colored inks. There are typically two process methods for transferring a colored image from the photoreceptor to the substrate. One method is a multi-shot process method in which the process described in the preceding paragraph is repeated a distinct printing separation for each color, and each color is transferred sequentially in distinct passes from the blanket to the substrate until a full image is achieved. With multi-shot printing, for each separation a molten film (with one color) is applied to the surface of the print substrate. A second method is a one-shot process in which multiple color separations are acquired on the blanket via multiple applications (each with one color) of liquid ink in from the photoconductor to the blanket, and then the acquired color separations are transferred in one pass from the blanket to the substrate.

A significant challenge in LEP printing is that the blanket held by the blanket drum and used for receiving the molten film from the photoconductor and transferring the image to a substrate is prone to move out of its correct position relative to the blanket drum. In this application, such movement of the blanket referred to as "blanket creep". In examples, the blanket drum may be a right circular cylinder, and a replaceable blanket may be installed so as to be wrapped around a curved surface of the blanket drum. In examples, the blanket creep may be a lateral creep from the correct or intended blanket position on the curved surface of the blanket drum to an incorrect or unintended position on the curved surface, e.g. a position where a border of the installed blanket is too close or too far away from a subject end of the blanket drum. In certain examples, an installed blanket may creep to one of the blanket drum ends due to unbalanced forces between a rotating photoconductor drum and the rotating blanket drum. Such blanket creep to the IR temperature reading area can cause a temperature sensor, e.g., an infrared ("IR") sensor or other temperature detecting sensor located at an end or edge of the blanket drum, to make erroneous measurements of blanket temperature and/or blanket drum temperature.

In turn, such inaccurate temperature readings can interfere with blanket and blanket drum temperature control as blanket drum temperature and significantly affect print quality and satisfaction with usage of the printing press. In some cases, the press will stop printing as a safety measure due to perceived excessive temperature. In other cases, in accurate temperature readings may lead to reduced life and early replacement of the blanket and other press components (e.g., a photoconductor that interfaces with the blanket, and/or heating lamps used to control temperature of the blanket and/or blanket drum).

To address these issues, various examples described in more detail below provide a system and a method that enables identification and remedy of blanket creep conditions. In an example, a first sensor located adjacent to a first end of a blanket drum may be utilized to take a first temperature reading, with a second sensor located adjacent to a second end of the blanket drum being utilized to take a second temperature reading. A blanket creep condition is identified where it is determined that a difference in the measured blanket drum temperatures is in excess of a predetermined threshold. In examples, the determined difference in temperatures may be a decrease at either the first end or the second end of the blanket drum. A remedial measure is caused to be performed to address the identified blanket creep condition.

In an example, the first sensor is to take the first temperature reading and the second sensor is to take the second temperature reading during a single rotation of the blanket drum. In other examples, the first sensor may take the first temperature reading and the second sensor may take the second temperature reading during a different rotations of the blanket drum.

In an example, the remedial measure caused to be performed may be to send a user message indicative that service is needed. In another example, wherein the identified blanket creep condition is indicated to have a creep direction towards the first end of the blanket drum, the remedial measure caused to be performed may be to send a user message that service is needed to address blanket creep at the first end. In another example, wherein the identified blanket creep condition is indicated to have a creep direction towards the first end, and the remedial measure may be to send to a blanket temperature controller temperature data calculated without consideration of the first temperature reading.

In a particular example, the first and second temperature readings may be taken during a first rotation of the blanket drum. In this example, during a second rotation of the blanket drum, the first sensor may be utilized to take a third temperature reading and the second sensor may be utilized to take a fourth temperature reading. In this example, the determined difference in temperatures at the blanket drum is a difference between the first temperature reading and the third temperature reading (taken by the first sensor at the first end of the drum during different rotations), or between the second temperature reading and the fourth temperature readings (taken by the second sensor at the second end of the drum during different rotations).

In this manner the disclosed apparatus and method will enable early blanket creep identification and implementation of remedial measures. Such early detection and remedies will mitigate or prevent print quality defects attributable to misdiagnosis of blanket and/or blanket drum temperatures. Users of LEP printing systems will further appreciate the enhanced safety of operation of the LEP press, and additional lifespans of the blanket, photoconductor, and heating lamp components, made possible by the disclosed apparatus and method. Installations and utilization of LEP printers should thereby be enhanced.

FIGS. 1-5 depict examples of physical and logical components for implementing various examples. In FIGS. 1-5 various components are identified as engines 114 and 116. In describing engines 114 and 116 focus is on each engine's designated function. However, the term engine, as used herein, refers generally to hardware and/or programming to perform a designated function. As is illustrated later with respect to FIG. 2, the hardware of each engine, for example, may include one or both of a processor and a memory, while the programming may be code stored on that memory and executable by the processor to perform the designated function.

FIG. 1 illustrates an example of a system 100 for identification and remedy of blanket creep conditions. In this example, system 100 includes a blanket drum 104 with a first end 106 and a second end 108, a blanket 102, a first sensor 110, a second sensor 112, a blanket creep identification engine 114, and a remedial measure engine 116. In performing their respective functions, blanket creep identification engine 114 and remedial measure engine 116 may access a data repository, e.g., a memory accessible to system 100 that can be used to store and retrieve data In an example, system 100 includes a blanket 102, also commonly referred to an "intermediate transfer member" or "ITM", that is to be situated upon a blanket drum 104. The blanket 102 is for receiving an image formed on a photoconductor, e.g., a photo receptor sheet attached to a rotating drum (a "first transfer") and transferring the image to a substrate (a "second transfer"), In examples the substrate may be brought into contact with the blanket 102 by an impression roller.

In examples, the blanket 102 may be a flexible blanket to be wrapped around a blanket drum 104 that is in the shape of a right circular cylinder, such that the cylindrical blanket drum 104 and the attached blanket 102 are then rotatable. In examples, the blanket may have a supportive portion and an outer release layer disposed on the supportive portion. In certain examples, the supportive portion may include a base, e.g., a metal base. In certain examples, the supportive portion of the blanket may include a layered structure disposed on a base. The layered structure may include a compliant substrate layer, for example a rubber layer, on which the outer release layer may be disposed. The release layer is for receiving the inked image as part of the first transfer and in turn convey the inked image to the print substrate as part of the second transfer. In certain examples, the blanket may include a primer layer that bonds or joins the release layer to the compliant layer. In examples, the primer layer may form part of the supportive portion of the blanket. In certain examples, the primer layer may be disposed on the compliant substrate layer.

In this example of system 100, blanket drum 104 includes a first end 106 and second end 108. As used herein an "end" of a drum refers generally to the outside horizontal limit of the blanket drum relative to a center of the drum when the axis of rotation for the drum is in a horizontal plane. In this example, "center" of the drum refers to a median point in the width of the drum when the drum is in the horizontal plane. In examples, the "ends" of the drum in the horizontal plane may also be referred to as drum "edges."

In this example, system 100 includes a first sensor 110 located adjacent to the first end 106 of the blanket drum 104, and a second sensor 112 located adjacent to the second end 108 of the blanket drum. The second end is opposite the first end of the blanket drum 104 if the drum is measured along its horizontal axis. The first sensor is to take a first temperature reading at the first end 106 during a rotation of blanket drum 104. The second sensor 112 is to take a second temperature reading at the second end 108 during a rotation of blanket drum 104. In examples, the first and second sensors may be infrared (commonly referred to as "IR") sensors. As used herein, an infrared sensor refers generally to any electronic instrument which can be used to measure heat of an object or of its surroundings by either emitting and/or detecting infrared radiation. In certain examples, the first sensor 110 and/or the second sensor 112 may be "fast response" IR sensors, e.g., IR sensors with response times fast enough to enable multiple temperature readings within a single rotation of the blanket drum. In a particular example, the first sensor 110 and the second sensor 112 each has a response time that is less than 5 ms.

Blanket creep identification engine 114 represents generally a combination of hardware and programming to identify a blanket creep condition at the blanket drum 104. In an example, blanket identification engine 114 may identify the blanket creep condition at the first end 106 of the blanket drum 104 upon having determined that a difference in blanket drum temperatures is in excess of a predetermined threshold.

As used herein with reference to measuring blanket creep, a "threshold" refers generally to a numerical value indicative of an acceptable condition or unacceptable condition. In examples, a predetermined threshold for analyzing differences may be expressed in degrees C. or degrees F. For instance, if a first temperature reading is 100 degrees C. and the second temperature reading is 95 degrees C., and the predetermined threshold is expressed as 2 degrees C., it can be said the difference between the first and second temperature readings exceeds the predetermined threshold.

In examples, the detected difference between temperature readings, to be compared to the predetermined threshold difference to indicate a blanket creep condition, will be a decrease in temperature. In examples, the blanket drum may include a heating element to heat the drum from the inside. In this example, a temperature reading taken by a sensor located at an end of the blanket drum is a function of temperature of the heated drum and temperature of the air surrounding the heated drum. During normal operations the expected temperature reading from a sensor at the end of the blanket drum may be 100 degrees C. In this example, a decrease in temperature of, say 5 degrees C., detected by the sensor at the end of the blanket drum can be attributed to the blanket having creeped to a position such that the blanket is between the end of the drum and the sensor. As the blanket will operate as an insulator in this scenario, thermal conductivity of the drum is reduced and the sensor at that end of the drum will detect a lower temperature than would be at the end than would be detected in a normal operation without the blanket creep.

In certain examples, then, the predetermined threshold for identifying a blanket creep condition at an end of a blanket drum may be a difference (e.g., a decrease) in temperature readings of 5 degrees C. In another example, predetermined threshold may be between 3 and 5 degrees C. In yet another example, the predetermined threshold may be a difference in temperature readings that is equal to >=5 percent of the normal operating temperature of the blanket drum.

In certain examples, the first sensor is to take the first temperature reading at the first end of the blanket drum and the second sensor is to take the second temperature reading at the second end during a single rotation of the blanket drum. In other examples, the first sensor is to take the first temperature reading at the first end of the blanket drum and the second sensor is to take the second temperature reading at the second end during different rotations of the blanket drum. Such different rotations can be, but need not be, immediately successive blanket drum rotations.

Remedial measure engine 116 represents generally a combination of hardware and programming to, upon identification of the blank creep condition by blanket creep identification component 114, cause performance of a remedial measure to address the identified blanket creep condition. In certain examples, remedial measure engine 116 may cause a remedial measure that includes sending of a user message indicative that a service is needed to address the identified blanket creep condition. Examples of such user messages include, but are not limited to, "Blanket Creep Detected—Service Needed", "Blanket Drum Servicing Needed", "Blanket Servicing Needed", "Blanket Drum Servicing Needed", "Intermediate Transfer Member Servicing Needed", "Intermediate Transfer Member Drum Servicing Needed", "Printer Servicing Needed", and "Technician Needed." In certain examples, the user message may be a message that is specific to the affected end of the blanket drum, e.g., describing the end of the blanket drum where the blanket creep has been detected. Examples of such specific user messages include, but are not limited to, "Blanket Creep Detected at Drum Left End—Service Needed" and "Blanket Creep Detected at Drum Right End—Service Needed."

In certain examples, the remedial measure may include ensuring that a blanket temperature controller does not utilize temperature readings taken by the sensor that has detected the blanket creep condition. As used herein, a "blanket temperature controller" refers generally to any combination of hardware and/or software that is to regulate or adjust the temperature of a blanket. In certain examples, the remedial measure taken by remedial measure engine 116 may include causing certain temperature data (e.g., temperature data generated by a sensor adjacent to a detected blanket creep condition) to not be sent to the blanket temperature controller. In other examples the remedial measure taken by remedial measure engine 116 include causing the blanket temperature controller to disregard temperature data received from the affected sensor.

In a particular example, where blanket creep identification engine 114 determines that the difference between the first temperature reading and a second temperature reading is indicative of a blanket creep condition at the first edge 106, remedial measure engine 116 may cause a first remedial measure. In this example, the first remedial measure includes sending to a blanket temperature controller temperature data calculated without consideration of the first and second temperature readings.

In a particular example, blanket creep identification engine 114 may affirmatively identify a blanket normal condition. In an example, the blanket normal condition may be identified responsive to blanket creep identification engine 114 having determine a difference in temperature readings (e.g., readings taken at the first end 106 and the second end 108 of the blanket drum 104) does not exceed a temperature reading threshold. In a particular example, responsive to having identified the blanket normal condition, blanket creep identification engine 114 may cause sending, to a blanket temperature controller, temperature data calculated in consideration of each of the first and second temperature readings. Temperature data from each of the first and second sensors can thus be considered by the blanket temperature controller, without the need for any remedial activity (e.g. remedial activity by remedial measure component 116), as no blanket creep detection was identified, and the temperature readings can be deemed accurate readings.

In a particular example, the first sensor located adjacent to a first end of the blanket drum and the second sensor located adjacent to the second end of the drum are utilized to take the first and second temperature readings during a first revolution of the drum. During a second revolution of the drum, the first sensor is utilized to take a third sensor reading at the first end of the drum and the second sensor is utilized to take a fourth sensor reading at the second end of the drum. In this particular example, blanket creep identification component 114 may identify a blanket creep condition responsive to determining that a difference, e.g., a decrease between the first temperature reading and the third temperature reading at the first end, or between the second temperature reading and the fourth temperature reading at the second end, is in excess of the predetermined threshold. Remedial measure component 116 in turn causes performance of a remedial measure to address the blanket creep condition.

Continuing with the particular example of the preceding paragraph, if blanket creep identification component 114 determines a difference between the first temperature reading and the third temperature reading at the first end is indicative of a blanket creep condition at the first end, and the remedial measure engine 116 may in turn send to a blanket temperature controller temperature data calculated without consideration of the first and third temperature readings. For instance, the remedial measure engine 116 may send the second and fourth temperature readings taken at the second end where there is no blanket creep, while not sending the first and third temperature readings taken where blanket creep has been determined to exist.

Continuing with the particular example of the preceding two paragraphs, blanket creep identification engine 114 may affirmatively identify a blanket normal condition responsive to determining a difference between the first temperature reading and the third temperature reading at the first end, and a difference between the second temperature reading and the fourth temperature reading at the second end, do not exceed the predetermined threshold. Responsive to this blanket position normal determination, blanket creep identification component 114 may send to a blanket temperature controller temperature data calculated in consideration of each of the first, second, third, and fourth temperature readings.

In the foregoing discussion of FIG. 1, engines 114 and 116 were described as combinations of hardware and programming, Engines 114 and 116 may be implemented in a number of fashions. Looking at FIG. 2 the programming may be processor executable instructions stored on a tangible memory resource 230 and the hardware may include a processing resource 240 for executing those instructions. Thus, memory resource 230 can be said to store program instructions that when executed by processing resource 240 implement system 100 of FIGS. 1-5.

Memory resource 230 represents generally any number of memory components capable of storing instructions that can be executed by processing resource 240. Memory resource 230 is non-transitory in the sense that it does not encompass a transitory signal but instead is made up of a memory component or memory components to store the relevant instructions. Memory resource 230 may be implemented in a single device or distributed across devices. Likewise, processing resource 240 represents any number of processors capable of executing instructions stored by memory resource 230. Processing resource 240 may be integrated in a single device or distributed across devices. Further, memory resource 230 may be fully or partially integrated in the same device as processing resource 240, or it may be separate but accessible to that device and processing resource 240.

In one example, the program instructions can be part of an installation package that when installed can be executed by processing resource 240 to implement system 100. In this case, memory resource 230 may be a portable medium such as a CD, DVD, or flash drive or a memory maintained by a server from which the installation package can be downloaded and installed. In another example, the program instructions may be part of an application or applications already installed. Here, memory resource 230 can include integrated memory such as a hard drive, solid state drive, or the like.

Figure 2:
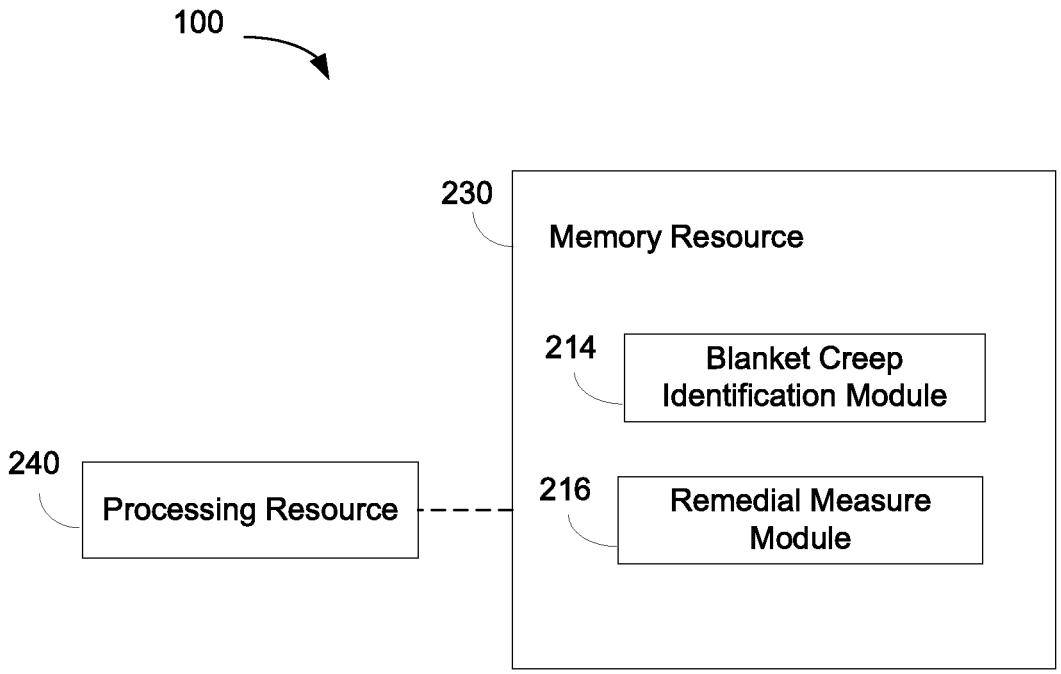
FIG. 2 is a block diagram depicting a memory resource and a processing resource to implement an example of a method to identify and remedy blanket creep conditions.

In FIG. 2, the executable program instructions stored in memory resource 230 are depicted as blanket creep identification module 214 and remedial measure module 216. Blanket creep identification module 214 represents program instructions that when executed by processing resource 240 may perform any of the functionalities described above in relation to blanket creep identification engine 114 of FIG. 1. Remedial measure module 216 represents program instructions that when executed by processing resource 240 may perform any of the functionalities described above in relation to remedial measure engine 116 of FIG. 1.

Figure 3:
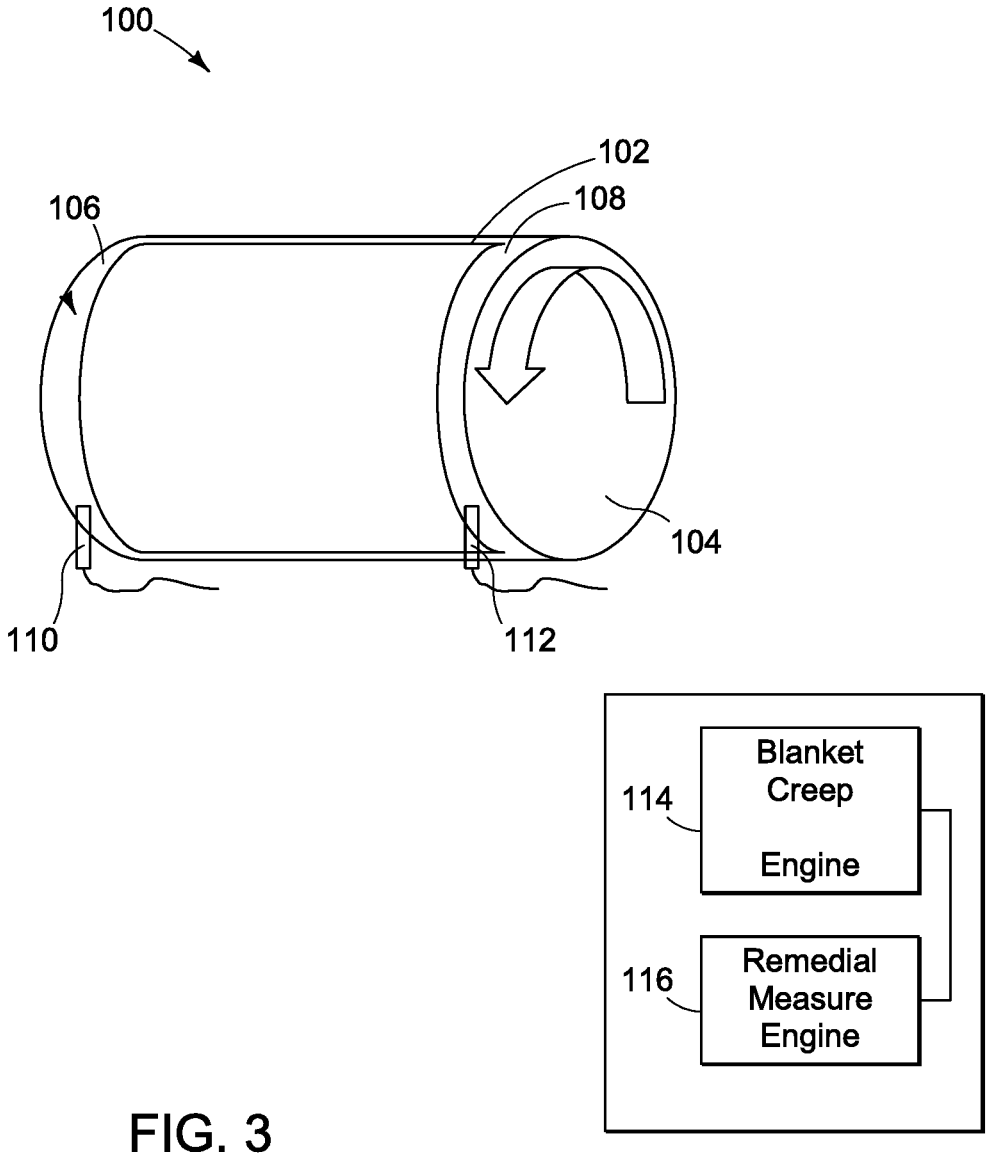
FIG. 3 illustrates an example of a system for identification and remedy of blanket creep conditions, wherein the system includes first and second sensors at located at ends of a blanket drum.
Figure 4:
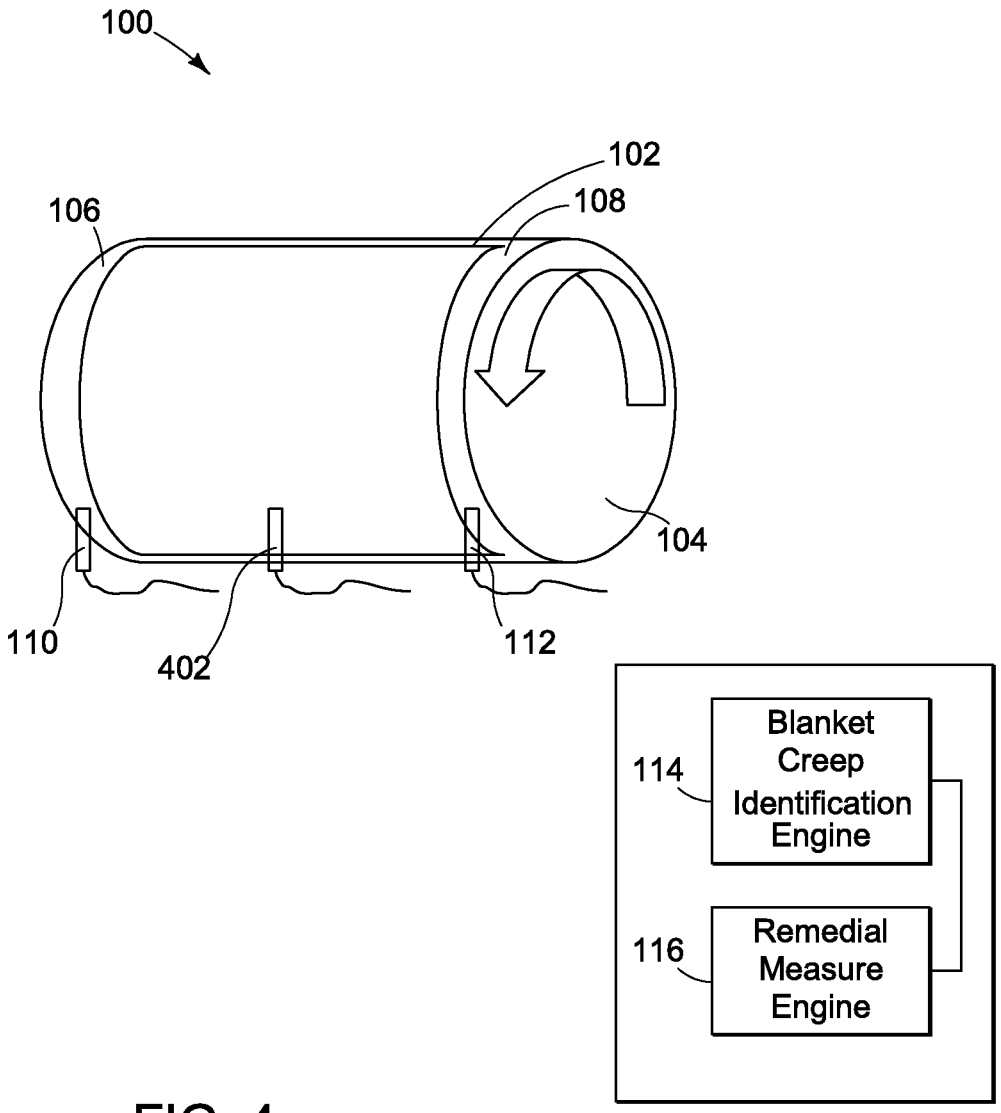
FIG. 4 illustrates an example of a system for identification and remedy of blanket creep conditions, wherein the system includes first and second sensors at ends of a blanket drum and a third sensor located between the first and second sensors and adjacent to the blanket drum.
Figure 5:
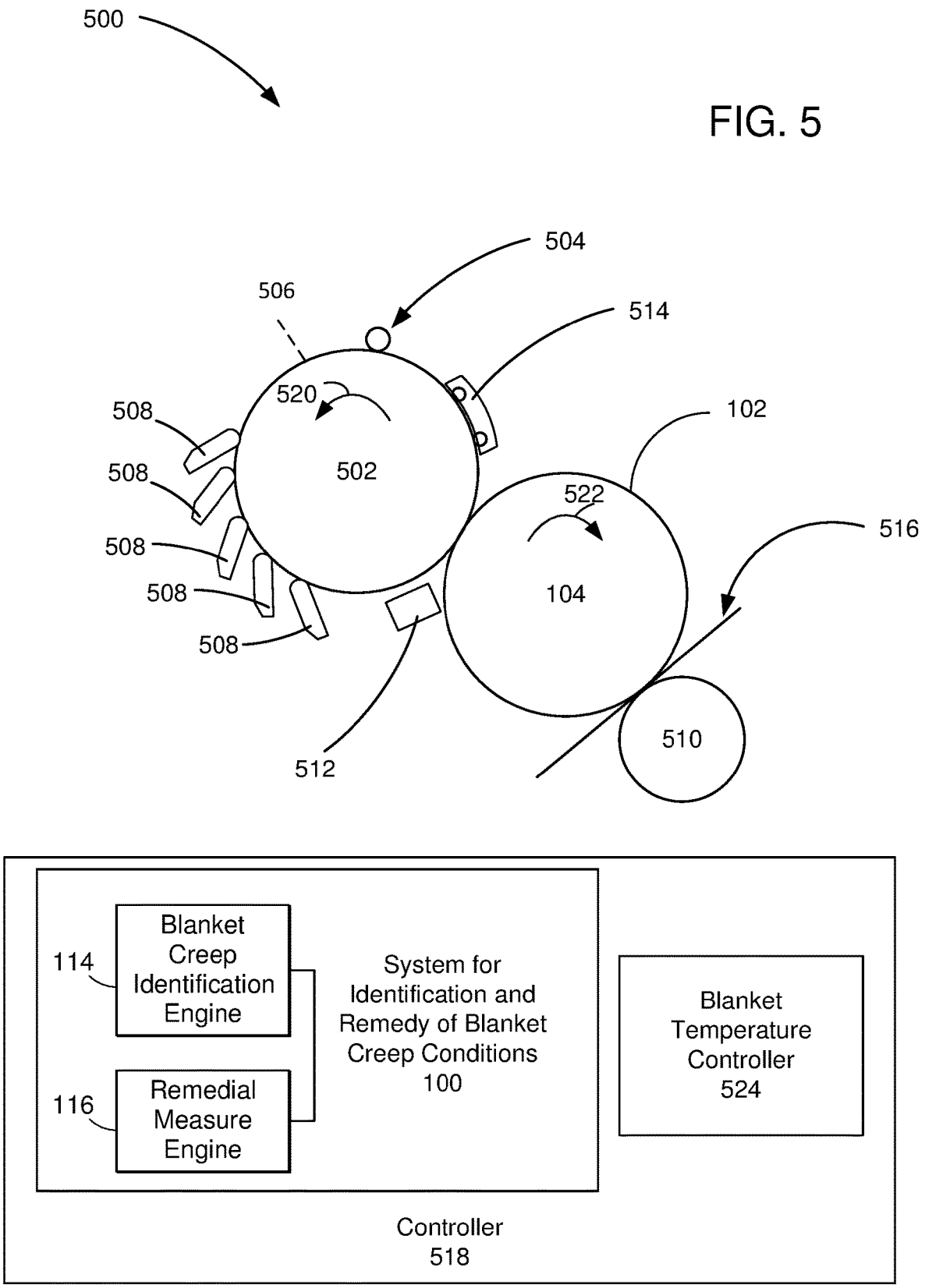
FIG. 5 is a schematic diagram showing a cross section of an example LEP printer 500 implementing the system for identification and remedy of blanket creep conditions 100 according to an example of the principles described herein.

FIGS. 3, 4, and 5 illustrate additional examples of a system for identification and remedy of blanket creep conditions. In the example of FIG. 3, a blanket 102 is situated upon rotatable blanket drum 104. First sensor 110 is located adjacent to a first edge 106 of blanket drum 104. First sensor 110 is to take a first temperature reading during one or more rotations of blanket drum 104. Second sensor 112 is located adjacent to a second edge 108 of blanket drum 104. Second sensor 112 is to take a second temperature reading during one or more rotations of blanket drum 104. In examples, one or both of first and second sensors 102 104 may be IR sensors. In examples, the first and second sensors 110 112 may have response times that are fast enough such that the sensors can make multiple temperature readings within a single blanket drum rotation.

Blanket creep identification engine 114 is to, upon determining that a difference in the blanket drum temperature readings is in excess of a predetermined threshold, identify a blanket creep condition. In an example, blanket creep identification engine may access a look up table or database that stores the predetermined threshold value. In an example, blanket creep identification engine may access a look up table or database that stores the predetermined threshold value in association with a specification (including, but not limited to a model number, a dimension, or a heating element characteristic) of blanket drum 104 or a printing press that includes blanket drum 104.

Remedial measure engine 116 is to, upon identification of the blank creep condition, cause performance of a remedial measure to address the blanket creep condition. In certain examples, the remedial measure may include sending a user message indicative that service is needed, e.g. directing the user to attend to the blanket creep at the blanket drum 104 end where the difference in temperature readings was outside the predetermined threshold. In certain examples, the remedial measure may include sending to a blanket temperature controller temperature data calculated without consideration of the temperature readings taken at the end at where blanket creep was detected.

Moving to FIG. 4, in some examples, system 100 may include, in addition to first sensor 110 located at first end 106 of blanket drum 104, and second sensor 112 located at second end 108, a third sensor 402 located adjacent to the drum between the first and second sensors 106 108. Third sensor 402 is for taking a third temperature reading of blanket drum 104, in a position more towards the center of the blanket drum relative to first and second sensors 106 108.

In an example, if blanket creep identification component 114 has determined that temperature readings taken by IR sensors are first end 106 or second end 108 of blanket drum 104 are indicative of a blanket creep condition at the first or second end 106 108, remedial measurement component 116 is to still send to the blanket temperature controller temperature data calculated in consideration of the third temperature reading. This is because third sensor 402 is located towards the center of the drum, where the blanket is present in normal operations, and temperature readings taken by the third sensor 402 should be accurate notwithstanding any blanket creep at one of the ends 106 108 of blanket drum 104.

FIG. 5 is a schematic diagram showing a cross section of an example LEP printer 500 implementing the system for identification and remedy of blanket creep conditions 100 according to an example of the principles described herein. Along with the elements previously described in connection with system for identification and remedy of blanket creep conditions 100, the LEP printer 500 may further include a PIP 502, a charging element 504, an imaging unit 506, developer systems 508, an impression cylinder 510, a discharging element 512, and a cleaning station 514.

According to the example of FIG. 5, a pattern of electrostatic charge is formed on a PIP 502 by rotating a clean, bare segment of the PIP 502 under a charging element 504. The PIP 502 in this example is cylindrical in shape, e.g. is constructed in the form of a drum, and rotates in a direction of arrow 520. In other examples, a PIP may planar or part of a belt-driven system.

Charging element 504 may include a charging device, such as corona wire, a charge roller, scorotron, or any other charging device. A uniform static charge is deposited on the PIP 502 by the charging element 504. As the PIP 502 continues to rotate, it passes an imaging unit 506 where one or more laser beams dissipate localized charge in selected portions of the PIP 502 to leave an invisible electrostatic charge pattern ("latent image") that corresponds to the image to be printed. In some examples, the charging element 504 applies a negative charge to the surface of the PIP 502. In other implementations, the charge is a positive charge. The imaging unit 506 then selectively discharges portions of the PIP 502, resulting in local neutralized regions on the PIP 502.

Continuing with the example of FIG. 5, developer systems 508 are disposed adjacent to the PIP 502 and may correspond to various print agent colors such as cyan, magenta, yellow, black, and the like. There may be one developer system 508 for each print agent color. In other examples, e.g., black and white printing, a single developer system 508 may be included in LEP printer 500. During printing, the appropriate developer system 508 is engaged with the PIP 502. The engaged developer system 508 presents a uniform film of print agent to the PIP 502. The print agent contains electrically-charged pigment particles which are attracted to the opposing charges on the image areas of the PIP 502. As a result, the PIP 502 has a developed image on its surface, i.e, a pattern of liquid toner corresponding with the electrostatic charge pattern (also sometimes referred to as a "separation").

The print agent may be a liquid toner, comprising ink particles and a carrier liquid. The carrier liquid may be an imaging oil. The ink particles may be electrically charged such that they move when subjected to an electric field. Typically, the ink particles are charged such that they are repelled from the similarly charged portions of PIP 502, and are attracted to the discharged portions of the PIP 502.

The print agent is transferred from the PIP 502 to an intermediate transfer member blanket 102. The blanket may be in the form of a rotatable drum 104, belt or other transfer system. In this particular example, the PIP 502 and blanket 102 are drums that rotate relative to one another, such that the color separations are transferred during the relative rotation. In the example of FIG. 5, the blanket 102 rotates in the direction of arrow 522. The transfer of a developed image from the PIP 502 to the blanket 102 may be known as the "first transfer", which takes place at a point of engagement between the PIP 502 and the blanket 102.

Once the layer of liquid toner has been transferred to the blanket 102, it is next transferred to a print substrate 516. This transfer from the blanket 102 to the print substrate may be deemed the "second transfer", which takes place at a point of engage between the blanket 102 and the print substrate 516. The impression cylinder 510 can both mechanically compress the print substrate 516 in to contact with the blanket 102 and also help feed the print substrate 516. In examples, the print substrate 516 may be a conductive or a non-conductive print substrate, including, but not limited to, paper, cardboard, sheets of metal, metal-coated paper, or metal-coated cardboard.

Controller 518 refers generally to any combination of hardware and software that is to control part, or all, of the LEP printer 500 print process. In examples, the controller 518 can control the voltage level applied by a voltage source, e.g., a power supply, to one or more of the imaging unit 506, the blanket 102, a drying unit, and other components of LEP printer 500. In this example controller 518 includes system 100 for identification and remedy of blanket creep conditions and the blanket temperature controller 524 that are discussed in detail with respect to FIGS. 1-4 herein.

Figure 6:
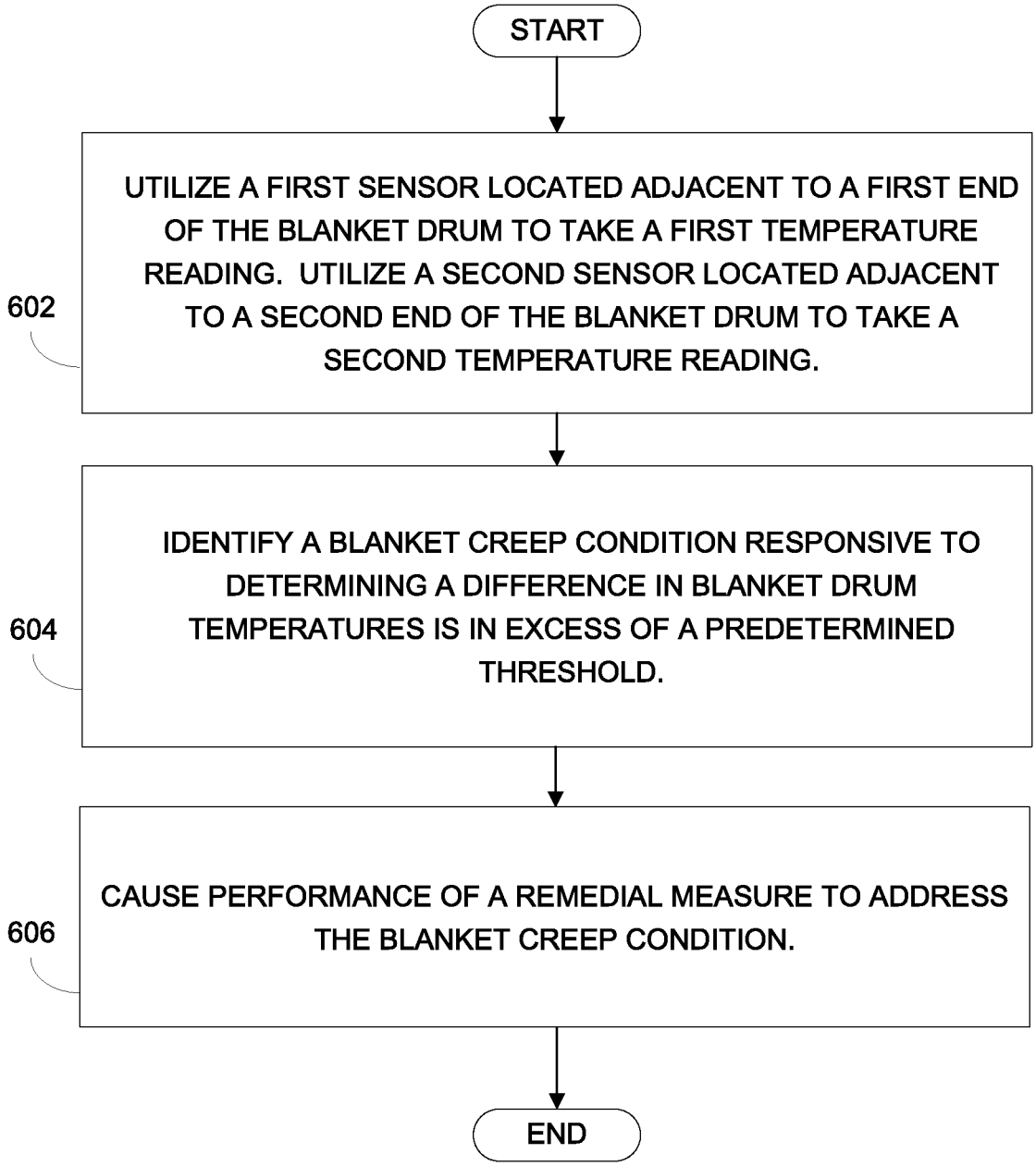
FIG. 6 is a flow diagram depicting an example implementation of a method for identification and remedy of blanket creep conditions.

FIG. 6 is a flow diagram of implementation of a method for identification and remedy of blanket creep conditions during printing. In discussing FIG. 6, reference may be made to the components depicted in FIGS. 1 and 2. Such reference is made to provide contextual examples and not to limit the manner in which the method depicted by FIG. 6 may be implemented. A first sensor located adjacent to a first end of a blanket drum is utilized to take a first temperature reading. A second sensor located adjacent to a second end of the blanket drum is utilized to take a second temperature reading (block 602), Referring back to FIGS. 1 and 2, blanket creep identification engine 114 (FIG. 1) or blanket creep identification module 214 (FIG. 2), when executed by processing resource 240, may be responsible for implementing block 602.

A blanket creep condition is identified responsive to determining a difference in blanket drum temperatures is in excess of a predetermined threshold (block 604), Referring back to FIGS. 1 and 2, blanket creep identification engine 114 (FIG. 1) or blanket creep identification module 214 (FIG. 2), when executed by processing resource 240, may be responsible for implementing block 604.

A remedial measure is caused to be performed to address the blanket creep condition (block 606), Referring back to FIGS. 1 and 2, remedial measure engine 116 (FIG. 1) or remedial measure module 216 (FIG. 2), when executed by processing resource 240, may be responsible for implementing block 606.

FIGS. 1-6 aid in depicting the architecture, functionality, and operation of various examples. In particular, FIGS. 1-5 depict various physical and logical components. Various components are defined at least in part as programs or programming. Each such component, portion thereof, or various combinations thereof may represent in whole or in part a module, segment, or portion of code that comprises executable instructions to implement any specified logical function(s), Each component or various combinations thereof may represent a circuit or a number of interconnected circuits to implement the specified logical function (s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein, A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 6 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A method to identify and remedy blanket creep conditions, comprising:

utilizing a first sensor located adjacent to a first end of a blanket drum to take a first temperature reading, and utilize a second sensor located adjacent to a second end of the blanket drum to take a second temperature reading;

identifying a blanket creep condition responsive to determining a difference in blanket drum temperatures is in excess of a predetermined threshold; and causing performance of a remedial measure to address the blanket creep condition, wherein the identified blanket creep condition is indicated to have a creep direction towards the first end, and the remedial measure is to send to a blanket temperature controller temperature data calculated without consideration of the first temperature reading.

2. The method of claim 1, wherein the first sensor is to take the first temperature reading and the second sensor is to take the second temperature reading during a rotation of the blanket drum.

3. The method of claim 1, wherein the remedial measure is to send a user message indicative that service is needed.

4. The method of claim 1, wherein the remedial measure is to send a user message that service is needed to address blanket creep at the first end.

5. The method of claim 1, further comprising identifying a blanket normal condition responsive to determining the difference in blanket drum temperatures is not in excess of the predetermined threshold; and responsive to identification of the blanket normal condition, sending to the blanket temperature controller temperature data calculated in consideration of each of the first and second temperature readings.

6. A method to identify and remedy blanket creep conditions, comprising:

utilizing a first sensor located adjacent to a first end of a blanket drum to take a first temperature reading, and utilize a second sensor located adjacent to a second end of the blanket drum to take a second temperature reading;

identifying a blanket creep condition responsive to determining a difference in blanket drum temperatures is in excess of a predetermined threshold; and causing performance of a remedial measure to address the blanket creep condition, wherein the first and second temperature readings are taken during a first rotation of the blanket drum;

further comprising, during a second rotation of the blanket drum, utilizing the first sensor to take a third temperature reading, and utilizing the second sensor to take a fourth temperature reading;

wherein the determined difference in temperatures is a difference between the first temperature reading and the third temperature reading, or between the second temperature reading and the fourth temperature reading.

7. The method of claim 6, wherein the determined difference in temperatures is a decrease at an end of the blanket drum as between the first and second rotations of the blanket drum.

8. The method of claim 6, wherein the determined difference between the first temperature reading and the third temperature reading at the first end is indicative of a blanket creep condition at the first end, and the remedial measure is to send to a blanket temperature controller temperature data calculated without consideration of the first and third temperature readings.

9. The method of claim 6, further comprising identifying a blanket normal condition responsive to determining a difference between the first temperature reading and the third temperature reading at the first end, and a difference between the second temperature reading and the fourth temperature reading at the second end, do not exceed the predetermined threshold; and responsive to identification of the blanket normal condition, sending to a blanket temperature controller temperature data calculated in consideration of each of the first, second, third, and fourth temperature readings.

10. A system for identification and remedy of blanket creep conditions, comprising:

a blanket to be situated upon a rotatable blanket drum, a first sensor located adjacent to a first edge of the blanket drum, the first sensor to take a first temperature reading during a rotation of the blanket drum;

a second sensor located adjacent to a second edge of the blanket drum to take a second temperature reading;

a blanket creep identification engine to, upon determining that a difference in blanket drum temperature readings is in excess of a predetermined threshold, identify a blanket creep condition; and a remedial measure engine to, upon identification of the blank creep condition, cause performance of a remedial measure to address the blanket creep condition, further comprising a third sensor located adjacent to the drum between the first and second sensors, the third sensor to take a third temperature reading of the blanket drum; and wherein the remedial measure engine is to send to a blanket temperature controller temperature data calculated in consideration of the third temperature reading.

11. The system of claim 10, wherein the first and second sensors are IR sensors with response times to enable multiple temperature readings within a drum rotation.

12. The system of claim 10, wherein the blanket is to be in contact with a rotatable photoconductor drum and is for receiving a first transfer of ink from the photoconductor drum; and wherein the blanket is to be in contact with a substrate and is for making a second transfer of the ink from the blanket to the substrate.

13. A memory resource storing instructions that when executed are to cause a processing resource to enable identification and remedy of blanket creep, comprising:

a blanket creep identification module, that when executed causes the processor to during a first rotation of a blanket drum, utilize a first sensor located adjacent to a first end of the blanket drum to take a first temperature reading of the blanket drum, and utilize a second sensor located adjacent to a second end of the blanket drum to take a second temperature reading of the blanket drum;

during a second rotation of the blanket drum, utilize the first sensor to take a third temperature reading of the blanket drum, and utilize the second sensor to take a fourth temperature reading of the blanket drum; and identify a blanket creep condition responsive to determining a difference between the first temperature reading and the third temperature reading, or as between the second temperature reading and the fourth temperature reading, is a decrease in excess of a predetermined threshold;

a remedial measure module, that when executed causes the processor to send to a blanket temperature controller temperature data calculated without consideration of the temperature readings having a decrease in excess of the predetermined threshold.

* * * * *